US006112652A

United States Patent [19]

Wurmbach

[11] Patent Number: 6,112,652

[45] Date of Patent: Sep. 5, 2000

[54] PRESS FOR THE STAMPING OF PLATES, PARTICULARLY VEHICLE LICENSE PLATES

[75] Inventor: Lothar Wurmbach, Siegen, Germany

[73] Assignee: Erich Utsch KG, Siegen, Germany

[21] Appl. No.: 09/374,572

[22] Filed: Aug. 13, 1999

[30] Foreign Application Priority Data

Aug. 14, 1998 [DE] Germany ..... 198 36 801

[51] Int. Cl.[7] ..... B31F 1/07

[52] U.S. Cl. ..... 101/28; 101/18; 72/455; 72/456

[58] Field of Search ..... 101/4, 6, 18, 19, 101/28, 32; 72/455, 456

[56] References Cited

U.S. PATENT DOCUMENTS

| | | | |
|---|---|---|---|
| 1,856,928 | 5/1932 | Pannier, Jr. | 101/28 |
| 2,077,128 | 4/1937 | Pannier, Jr. | 101/28 |
| 3,112,688 | 12/1963 | Pannier | 101/18 |
| 3,898,925 | 8/1975 | Alexander | 101/18 |
| 3,901,143 | 8/1975 | Alexander et al. | 101/18 |
| 3,987,721 | 10/1976 | Alexander et al. | 101/18 |
| 4,339,994 | 7/1982 | Crasnianski et al. | 101/4 |
| 5,826,504 | 10/1998 | Elmassian | 101/32 |

FOREIGN PATENT DOCUMENTS

| | | | |
|---|---|---|---|
| 7602 | 5/1915 | United Kingdom | 101/28 |

*Primary Examiner*—Eugene Eickholt
*Attorney, Agent, or Firm*—Freidrich Kueffner

[57] ABSTRACT

A press for the stamping of plates, in combination with a cutting apparatus, provided with two magazines that are formed on the press table, while the magazines accommodate registers that are positioned horizontally with respect to one another, whereby each register encompasses a series of holders for stamping tools that have the same or differing width. The holders are positioned vertically with respect to one another. The stamping tools are combined in pairs and, by computer control, can be positioned at the height of the press table by vertical drives and horizontal drives and into correspondence with the plate design that is to be stamped into a sheet metal strip. The stamping tool pairs can also be slid into the press, and be removable therefrom, by additional horizontal drives using the press, it is possible to stamp out plates, particularly vehicle license plates, having a design in which the individual symbols are either in registered layout or in a free (or non-registered) layout.

14 Claims, 2 Drawing Sheets

1
2
3
4
5
6
7
8
9
10
11
12
13
14
15
16
17
18
19
20
21
22
23
a
b
c
d

PRESS FOR THE STAMPING OF PLATES, PARTICULARLY VEHICLE LICENSE PLATES

BACKGROUND OF THE INVENTION

1. Field of the Invention

The present invention relates to a press for the stamping of plates, particularly vehicle license plates having license numbers. The license plates are made from sheet metal material, itself in the form of strip material or individual plates, that is fed in synchronized manner into the press. The press includes a press stand comprised of a press table and a press stamp, as well as interchangeable stamping tools.

2. Description of the Related Art

Presses of the above type, as found in DE 32 03 801 C2, are furnished with tools, embodied as block tools, having a uniform width. The tools are used for stamping license numbers (having letters and numbers) in vehicle license plates and do so in registered layout, or in a registered print style, as known in Germany.

In other countries such as Austria, the figures on the license plate are stamped in a non-registered layout, or in a free print style. In other words, the stamping tools have a width that can be tailored to the width of letters, numbers and, if need be, coats of arms.

The present invention seeks to develop a press for the stamping of plates, particularly vehicle license plates with license numbers in any linear order, so that it can be furnished with stamping tools of uniform width (i.e. uniform registration) as well as with tools having different widths.

SUMMARY OF THE INVENTION

The above objective can achieved, in accordance with at least one presently preferred embodiment of the present invention, with a press for stamping plates that has the following features:

two magazines, provided at both longitudinal sides of the press table in parallel to the direction of travel of the sheet metal material, that have registers that are placed horizontally in a row next to one another, whereby each register encompasses a series of holders for stamping tools, the holders being positioned vertically with respect to one another, the stamping tools having a uniform width or a width that is tailored to that of the respective symbols, the stamping tools being for the stamping of plates with letters and/or numerals and/or emblems in a registered layout or a free layout, and whereby each register is equipped with a vertical drive for positioning the individual stamping tools, in correspondence with the respective license number that is to be stamped on the plate, at the height of the press table, wherein the registers of both magazines are combined in pairs in such a way that both registers of one register pair border on a common vertical plane, the press further including horizontal drives for sliding, in pairs or individually, those stamping tools that have been moved to the height of the press table, whereby the sliding takes place at both longitudinal sides of press table, in the plane of travel of the sheet metal material both in and out of the direction of travel of the sheet metal material, in order to precisely position the stamping tools with respect to the sheet metal material in correspondence with the proper order of the license number to be stamped, the press further including horizontal drives for sliding stamping tools in the open press, once the stamping tools have been moved into position, individually or in pairs, from the holders of the individual registers, transversely with respect to the direction of travel of the sheet metal material, so as to stamp a license number into the sheet metal material, whereby the horizontal drives also draw the stamping tools back from press into the corresponding holders in registers, and the press also including a control, via a computer, for the vertical drives of the individual registers, having the holders for stamping tools, and for the horizontal drives of the holders for when the holders are positioned at the height of the press table with their stamping tools, which horizontal drives position the stamping tools in correspondence with the license number that is to be stamped into the sheet metal material.

The inventive plate stamping press distinguishes itself through the technical advantages derived from the contemplated embodiment.

BRIEF DESCRIPTION OF THE DRAWINGS

The present invention is elucidated herebelow in connection with the schematic drawings in FIGS. 1 and 2, which illustrate a press table of a license plate stamping press in plan view and a license plate with the number WI 18 A J.

DESCRIPTION OF THE PREFERRED EMBODIMENTS

Figure 1:
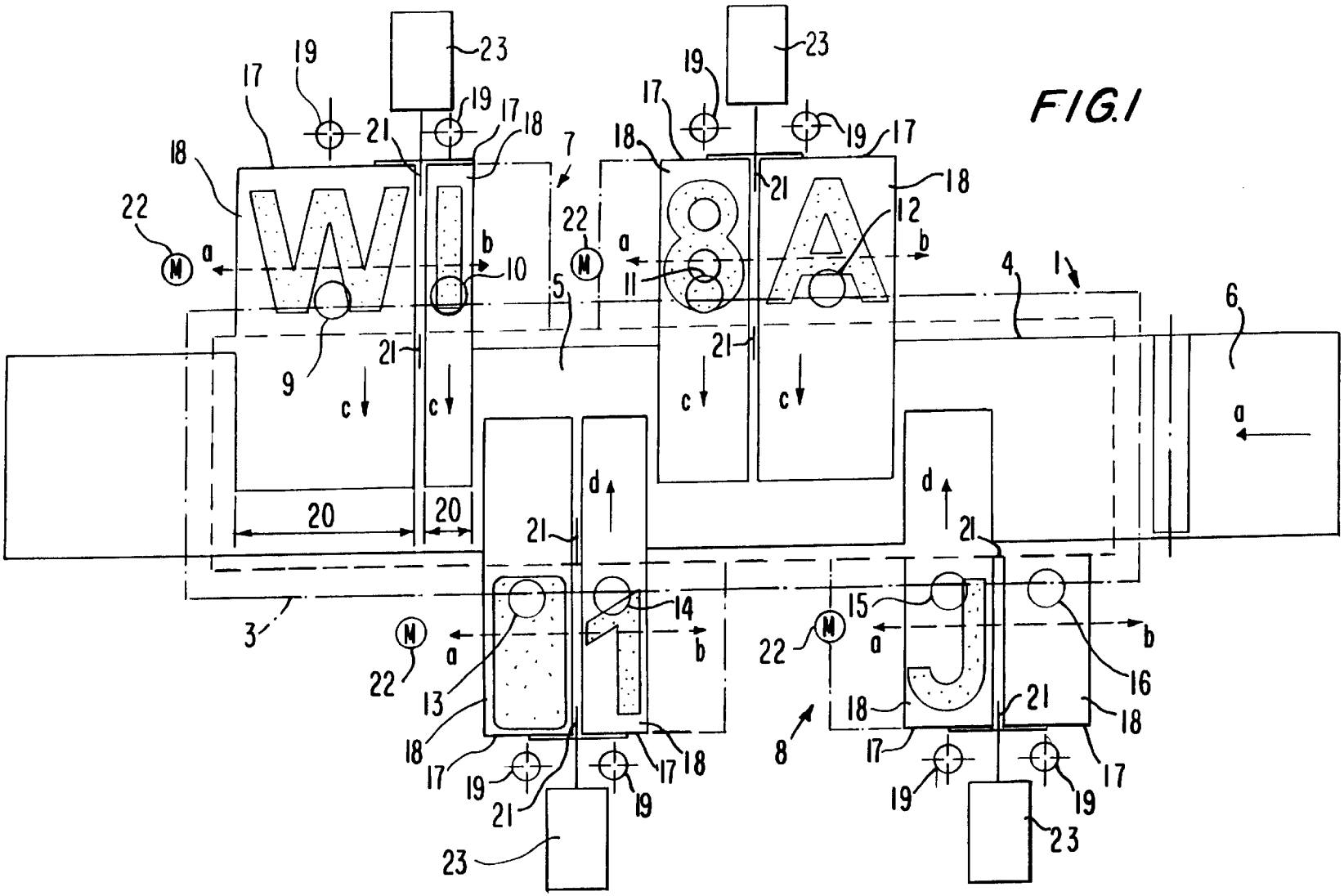
Figure 2:
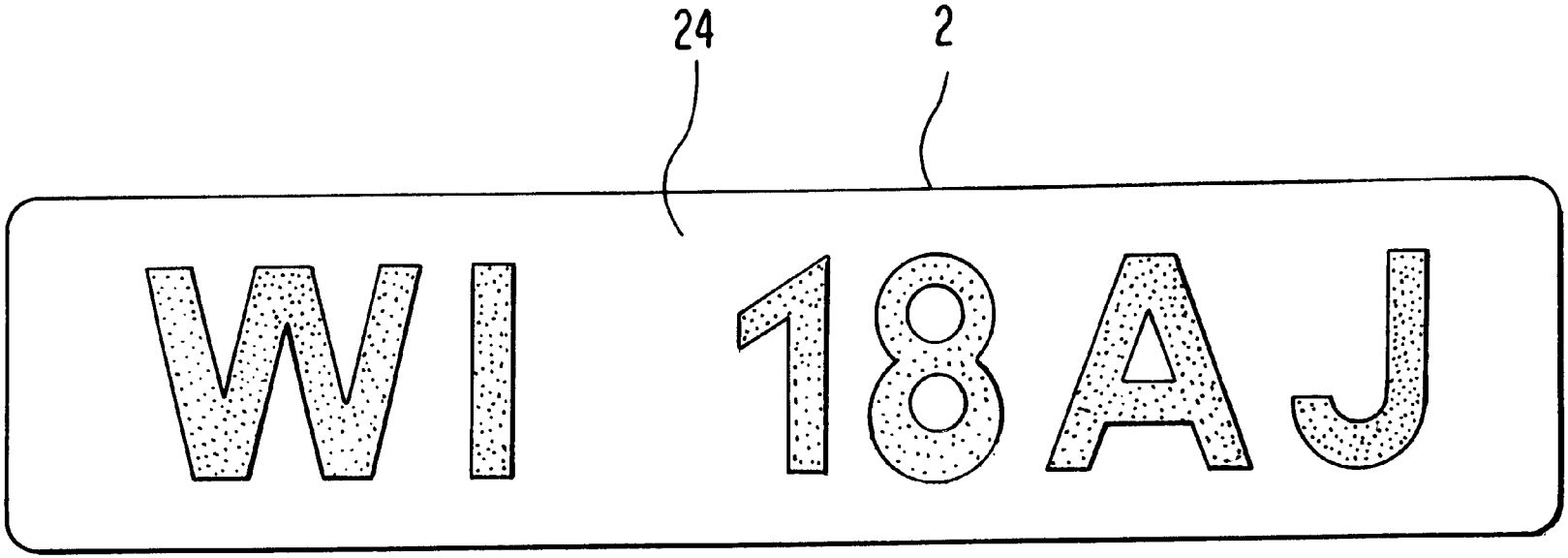

The press 1 shown in FIG. 1, which is for stamping license plates 2 such as shown in FIG. 2, includes a press stand 3 with a press table 4 in the form of a lift table. Press 1 also includes a press stamp 5 that is fixed and mounted on a mounting beam.

On both longitudinal sides of the press table 4, there are two magazines 7, 8 in parallel with respect to the travel direction a of a sheet metal strip (e.g. aluminum strip) 6 that is covered with a reflective foil and is fed into the press in synchronized manner by means of a strip conveyor not shown. The magazines 7, 8 each have, for example, four registers 9–12 and 13–16 in a row that are mounted horizontally next to one another. Each register 9–12, 13–16 encompasses a series of holders 17 positioned vertically with respect to one another. These holders 17 are for stamping tools 18 that are intended for stamping the letters A–Z and numerals 0–9. Each register 9–12, 13–16 is also equipped with a vertical drive 19 that positions the individual stamping tools 18 at the height of the press table 4 in correspondence with the license number 2 that is to be stamped. The stamping tools 18 have a varying width 20 that is tailored to the respective width of each letter A–Z and numeral 0–9.

The registers 9–12, 13–16 of both magazines 7, 8 are joined in pairs so that both registers of one register pair 9, 10; 11, 12; 13, 14; 15, 16 border on a common vertical plane 21—21.

Horizontal drives 22 serve to slide, in pairs, those stamping tools 18 belonging to registers 9—12; 13—16 that have been moved to the height of the press table 4. The sliding takes place at both longitudinal sides of press table 4 in the plane of travel of the sheet strip 6 both in and out of the direction of travel (a, b) of the sheet strip. The intent is to precisely position the stamping tools 18 with respect to the sheet strip 6 in correspondence with the proper order of the license number to be stamped (e.g., the number WI 18 A J), which could also include an open field 24 reserved for the introduction of a coat of arms or seal.

Press 1 is further equipped with additional horizontal drives 23 for sliding stamping tools 18 into the open press 1, once they have been moved into position, individually or in pairs, from the holders 17 of the individual registers 9–12, 13–16 of both magazines 7, 8, in the direction of arrows c, d transversely with respect to the direction of travel a of the sheet metal strip, so as to stamp a license number of a license plate 2 (e.g., the number WI 18 A J) into the sheet metal strip 6. The drives 23 also draw the stamping tools 18 back from press 1 into the corresponding holders 17 in registers 9–12, 13–16.

A computer is provided to control the vertical drives 19 of the individual registers 9–12, 13–16 having the holders 17 for stamping tools 18, and also to control the horizontal drives 22 of the holders 17 (when the holders 17 are positioned at the height of the press table 4 with their stamping tools 18), which horizontal drives 22 position the stamping tools in correspondence with the license number (of a vehicle license plate) that is to be stamped into the sheet metal strip 6.

When the license number is stamped, the press 1, which is embodied as a cutting and stamping press, can cut the license plate 2 from the sheet metal strip 6.

As a variant of the embodiment described above, the registers 9—12 13–16 of both magazines 7, 8 of the press 1 could be furnished with stamping tools 18 that have a uniform width, so as to stamp plates, especially vehicle license plates, with letters and numerals that are in a registered layout.

Additionally, the press table 4 could be fixed in position and the press stamp 5 could be displaced hydraulically.

While specific embodiments of the invention have been shown and described in detail to illustrate the inventive principles, it will be understood that the invention may be embodied otherwise without departing from such principles.

What is claimed is:

1. A press for stamping license plates, having a license pattern comprising at least one of: at least one letter, at least one numeral and at least one symbol; out of sheet material fed into said press, said press comprising:

a press stand comprising a press table and a press stamp;

said press table having two longitudinal sides;

two magazines provided at both longitudinal sides of said press table in parallel to the direction of travel of the sheet material;

said magazines comprising a plurality of registers disposed horizontally in a row next to one another;

each said register comprising a plurality of holders;

a plurality of stamping tools for being held in said holders;

said stamping tools comprising at least one of: at least one letter, at least one numeral and at least one emblem;

said holders being positioned vertically with respect to one another;

each register including a vertical drive for positioning selected ones of said stamping tools at the height of said press table;

said registers being combined in pairs, wherein both registers within each said pair border on a common vertical plane; and at least one horizontal drive for:

sliding stamping tools that have been positioned at the height of said press table so as to precisely position said stamping tools in correspondence with a license pattern to be stamped; and thereafter sliding said stamping tools from said holders into and out of a direction that is transverse to the direction of travel of the sheet material, in preparation for stamping.

2. The press according to claim 1, wherein said at least one horizontal drive comprises two independent sets of horizontal drives comprising:

a first set of horizontal drives for sliding stamping tools that have been positioned at the height of said press table so as to precisely position said stamping tools in correspondence with a license pattern to be stamped; and a second set of horizontal drives for thereafter sliding said stamping tools from said holders into and out of a direction that is transverse to the direction of travel of the sheet material, in preparation for stamping.

3. The press according to claim 2, wherein said first set of horizontal drives move said stamping tools individually.

4. The press according to claim 2, wherein said first set of horizontal drives move said stamping tools in pairs.

5. The press according to claim 2, wherein said second set of horizontal drives move said stamping tools individually.

6. The press according to claim 2, wherein said second set of horizontal drives move said stamping tools in pairs.

7. The press according to claim 1, further comprising a computer control for said vertical drives and for said at least one horizontal drive.

8. The press according to claim 1, wherein said stamping tools have a uniform width.

9. The press according to claim 1, wherein said stamping tools have widths that are tailored to the respective symbol represented by each stamping tool.

10. The press according to claim 1, comprising means for arranging said stamping tools in a registered layout.

11. The press according to claim 1, comprising means for arranging said stamping tools in a free layout.

12. The press according to claim 1, wherein said press comprises a cutting and stamping press.

13. The press according to claim 2, wherein:

said first set of horizontal drives move said stamping tools in one of: individual fashion or tandem fashion;

said second set of horizontal drives move said stamping tools in one of: individual fashion or tandem fashion;

said press further comprises a computer control for said vertical drives and for at least first set of horizontal drives;

said stamping tools have one of: a uniform width or widths that are tailored to the respective symbol represented by each stamping tool; and said press comprises means for arranging said stamping tools in one of: a registered layout or a free layout.

14. The press according to claim 13, wherein said press comprises a cutting and stamping press.

* * * * *